US008425344B2

(12) United States Patent
Evans et al.

(10) Patent No.: US 8,425,344 B2
(45) Date of Patent: Apr. 23, 2013

(54) VARIABLE LENGTH GOLF CLUB SHAFT

(75) Inventors: D. Clayton Evans, San Marcos, CA (US); Tim Goudarzi, San Marcos, CA (US); Matthew T. Cackett, San Diego, CA (US)

(73) Assignee: Callway Golf Company, Carlsbad, CA (US)

( * ) Notice: Subject to any disclaimer, the term of this patent is extended or adjusted under 35 U.S.C. 154(b) by 303 days.

(21) Appl. No.: 13/008,806

(22) Filed: Jan. 18, 2011

(65) Prior Publication Data

US 2012/0184389 A1 Jul. 19, 2012

(51) Int. Cl.
*A63B 53/16* (2006.01)

(52) U.S. Cl.
USPC ..... 473/296; 473/299; 473/288

(58) Field of Classification Search ..... 473/296, 473/239, 297–299, 294, 288, 305
See application file for complete search history.

(56) References Cited

U.S. PATENT DOCUMENTS

| | | | | |
|---|---|---|---|---|
| 2,464,850 | A | 3/1949 | Crawshaw | |
| 4,010,958 | A | 3/1977 | Long | |
| 4,340,227 | A | 7/1982 | Dopkowski | |
| 4,415,156 | A | 11/1983 | Jorgensen | |
| 4,600,195 | A * | 7/1986 | Hunter | 473/297 |
| 4,688,798 | A | 8/1987 | Pelz | |
| 4,793,616 | A | 12/1988 | Fernandez | |
| 5,294,118 | A | 3/1994 | Iwanaga | |
| 5,465,967 | A * | 11/1995 | Boeckenhaupt | 473/297 |
| 5,470,068 | A | 11/1995 | Schmidt et al. | |
| 5,632,691 | A | 5/1997 | Hannon et al. | |
| 5,951,412 | A | 9/1999 | Rose et al. | |
| 5,997,412 | A | 12/1999 | Benson | |
| 6,007,431 | A * | 12/1999 | Bloom, Jr. | 473/292 |
| 6,086,484 | A | 7/2000 | Uebelhor | |
| 6,343,999 | B1 | 2/2002 | Murtland et al. | |
| 6,375,583 | B1 | 4/2002 | Solheim | |
| 6,796,911 | B2 | 9/2004 | Grace | |
| 6,932,711 | B2 | 8/2005 | Benson | |
| RE38,983 | E | 2/2006 | Antonious | |
| 7,195,565 | B2 * | 3/2007 | White et al. | 473/296 |
| 7,510,482 | B2 | 3/2009 | Benson | |
| 7,563,173 | B2 | 7/2009 | Chol | |
| 7,704,161 | B2 * | 4/2010 | Lindner | 473/297 |
| 7,874,932 | B2 | 1/2011 | Chol | |

(Continued)

OTHER PUBLICATIONS

Acculength Junior Golf Innovation "The Only Clubs that Grow with Kids" website www.acculength.com/page/332-17104.htm 17104.htm 3 pages, Feb. 19, 2013.*

(Continued)

*Primary Examiner* — Stephen L. Blau
(74) *Attorney, Agent, or Firm* — Rebecca Hanovice; Michael A. Catania; Sonia Lari

(57) ABSTRACT

A variable length shaft assembly comprising at least one upper shaft portion, a lower shaft portion and a threaded fastener, wherein the threaded fastener removably connects the upper shaft portion to the lower shaft portion, is disclosed herein. The variable length shaft assembly may further comprise at least two upper shaft portions having different lengths so a golfer can adjust the total length of the shaft by removing one upper shaft portion and replacing it with another upper shaft portion having a different length. Methods of adjusting the length of a golf club shaft without damaging any portion of the shaft and variable length shaft kits are also disclosed herein.

14 Claims, 5 Drawing Sheets

U.S. PATENT DOCUMENTS

| | | | | |
|---|---|---|---|---|
| 2001/0005696 | A1 | 6/2001 | Hedrick | |
| 2004/0102255 | A1* | 5/2004 | Benson | 473/296 |
| 2004/0116197 | A1* | 6/2004 | Benson | 473/239 |
| 2005/0143186 | A1* | 6/2005 | Blattner et al. | 473/296 |
| 2008/0081708 | A1* | 4/2008 | Wilmsen et al. | 473/297 |
| 2009/0270197 | A1* | 10/2009 | Holtzman | 473/296 |
| 2010/0081515 | A1* | 4/2010 | White et al. | 473/296 |
| 2010/0304881 | A1 | 12/2010 | Chol | |
| 2011/0081984 | A1* | 4/2011 | Beach et al. | 473/296 |
| 2011/0159982 | A1* | 6/2011 | Takeuchi | 473/299 |

OTHER PUBLICATIONS

Acculength Junior Golf Innovation www.acculength.com/page/332-17104.htm, 3 pages, Feb. 19, 2013.

* cited by examiner

VARIABLE LENGTH GOLF CLUB SHAFT

CROSS REFERENCES TO RELATED APPLICATIONS

The present application claims priority to U.S. Provisional Patent Application No. 61/422,982, filed on Dec. 14, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a variable length shaft assembly that allows for quick, semi-permanent length adjustments. More specifically, the present invention relates to a variable length shaft whose length can be adjusted in a short period of time with the use of shaft extension components having different lengths.

2. Description of the Related Art

Customization of golf clubs to help golfers attain better shots has become a popular and more prevalent practice in recent years. Golf club manufacturers and designers have devised various features to allow club fitters and golf club players to adjust certain characteristics of their clubs. Such characteristics include loft, lie, face angle, center of gravity (CG) location, and club length.

Current technology provides two methods to adjust overall club length. One such method involves the destruction and removal of the grip on a shaft. Upon removal of the grip by peeling or tearing, the end portion of the shaft is trimmed to decrease the club length or an extension piece ise affixed to the end of the shaft to increase its length. Aftermarket extensions are available specifically for this purpose; alternatively, extensions can be made from portions of other golf club shafts that are cut to the desired length and then inserted into the end of the first club's shaft. The extension piece must match the diameter of the existing shaft, so it is necessary at times to build up the diameter of the extension or existing shaft by adding layers of tape. This method requires that the user making the adjustments have access to potentially expensive new components and tools as well as having a high level of skill. It also causes damage to the original shaft and grip.

The second method of adjusting club length involves replacing the entire shaft and grip using a semi-permanent head-shaft connection device that some manufacturers offer with their clubs, particularly with drivers. The existing shaft may be removed from the driver head and replaced with a different shaft that has either a shorter or longer length. This method is not possible on all clubs, however, as the head must have hardware that allows for removal of the shaft and replacement with a new shaft without damaging the head.

A golfer who does not possess club altering skills or the necessary disposable income to purchase new components likely will be daunted by these two methods of adjusting club length. The first method requires the golfer to make use of several tools to remove the grip and cut the shaft if he or she desires a shorter length, and also to have materials such as tape and a replacement grip on hand to replace the grip and mend any damage caused to the shaft and grip. The skill set required to change the shaft length using this method is usually beyond the abilities of the average golfer, so the golfer would need to seek the services of a golf club fitter or technician to have their club length changed. The second method requires the golfer to buy an entirely new shaft at a different length, which can be very expensive, and also may require the golfer to retain a golf club fitter or technician to replace the shaft.

Ultimately, the two methods described above require an inventory of spare components and above average technical skill, particularly with regard to the first method. It is therefore desirable to facilitate the change of a club's length using a faster, easier, and less expensive system and method than is currently available.

BRIEF SUMMARY OF THE INVENTION

One aspect of the present invention is a variable length golf club shaft comprising at least one upper shaft portion, a lower shaft portion, and a threaded fastener, wherein the threaded fastener removably connects the upper shaft portion to the lower shaft portion. The upper shaft portion may further comprise an upper shaft piece and an upper grip piece, and the lower shaft portion may further comprise a lower shaft piece and a lower grip piece. The upper shaft piece and the lower shaft piece may be composed of a material selected from the group consisting of aluminum, aluminum alloy, titanium, titanium alloy, steel, magnesium, magnesium alloy, plastic, and graphite composite, and in a further embodiment the upper and lower shaft pieces may be composed of graphite composite.

In a further embodiment, the variable length golf club shaft further comprises an upper adapter having a hole through its center and a lower adapter having a threaded hole through its center, wherein the upper adapter is affixed to a lower, interior surface of the upper shaft portion, wherein the lower adapter is affixed to an upper, interior surface of the lower shaft portion, and wherein the threaded fastener is insertable through the holes in the center of the upper and lower adapters. The head portion of the threaded fastener may be permanently enclosed by a screw captivator affixed to the upper adapter. The upper and lower adapters of the variable length golf club shaft may be composed of a material selected from the group consisting of aluminum, aluminum alloy, titanium, titanium alloy, steel, magnesium, magnesium alloy, plastic, and graphite composite.

The variable length golf club shaft may further comprise an upper o-ring disposed proximate the upper adapter and a lower o-ring disposed proximate the lower adapter. The variable length golf club shaft may also further comprise at least two upper shaft portions, wherein the at least two upper shaft portions have different lengths. The at least two upper shaft portions may differ in length from each other by no less than 0.5 inch, and they may differ in weight from each other or have the same weight.

Another aspect of the present invention is a method of adjusting the length of a golf club shaft comprising providing an assembled golf club shaft having a first removable upper portion with a first threaded fastener and a lower portion, loosening the first threaded fastener engaging a lower surface of the first removable upper portion to an upper surface of the lower portion, removing the first removable upper portion from the lower portion, aligning a lower surface of a second removable upper portion having a second threaded fastener with the upper surface of the lower portion, and tightening the second threaded fastener such that the second upper removable portion is semi-permanently affixed to the lower portion, wherein the first removable upper portion has a length that differs from the length of the second removable upper portion.

Yet another aspect of the present invention is a method of adjusting the length of a golf club shaft comprising removing a first upper portion from the golf club shaft, replacing the first upper portion of the golf club shaft with a second upper portion having a length that differs from that of the first upper portion, and securing the second upper portion to the golf club shaft, wherein the removing, replacing, and securing does not cause damage to any portion of the golf club shaft.

Another aspect of the present invention is a kit comprising at least two upper shaft portions, a lower shaft portion, a threaded fastener, and a tool, wherein the at least two upper shaft portions have different lengths, wherein the tool engages the threaded fastener to tighten or loosen the threaded fastener, and wherein the threaded fastener removably connects the lower shaft portion with the at least two upper shaft portions. The at least two upper shaft portions may have different weights, or may have the same weight.

DETAILED DESCRIPTION OF THE INVENTION

The present invention is directed to a variable length shaft that provides club length adjustability. Club length adjustability is an advantageous feature for golf clubs because, for example, extending the length of a club can have the desired effect of increasing club head speed, which results in longer driving distances. Conversely, shortening the length of a club would provide a golfer with more control and accuracy in driving the golf ball. Golf course conditions often require accurate driving due to hazards, including but not limited to water, rough, and out of bounds markers, and driving accuracy can be more preferred than driving distance in competitive situations.

The present invention is also valuable because a golfer's swing may change over time, thus requiring alterations to his or her clubs. A golfer may improve his or her game through lessons and may gain greater flexibility and strength through practice and exercise. As such, it is reasonable for a golfer to wish to change his or her club's length to help improve his or her accuracy, distance, and feel as needed or desired.

The present invention provides golfers with a system and method to easily, quickly and inexpensively modify the length of their golf clubs to have them perform in a desired manner. This invention will enable golfers to change their club length wherever they wish, including, but not limited to, at the practice range, the golf course, and their home. The present invention also is designed to avoid altering a club's swing weight or its "feel." The tool and components that are used to alter a club's length are small and can be carried in a pocket of the user's golf bag. Furthermore, the technical ability required to modify the golf club length according to this invention is minimal and its approach is intuitive and easy for a golfer to understand.

Figure 1:
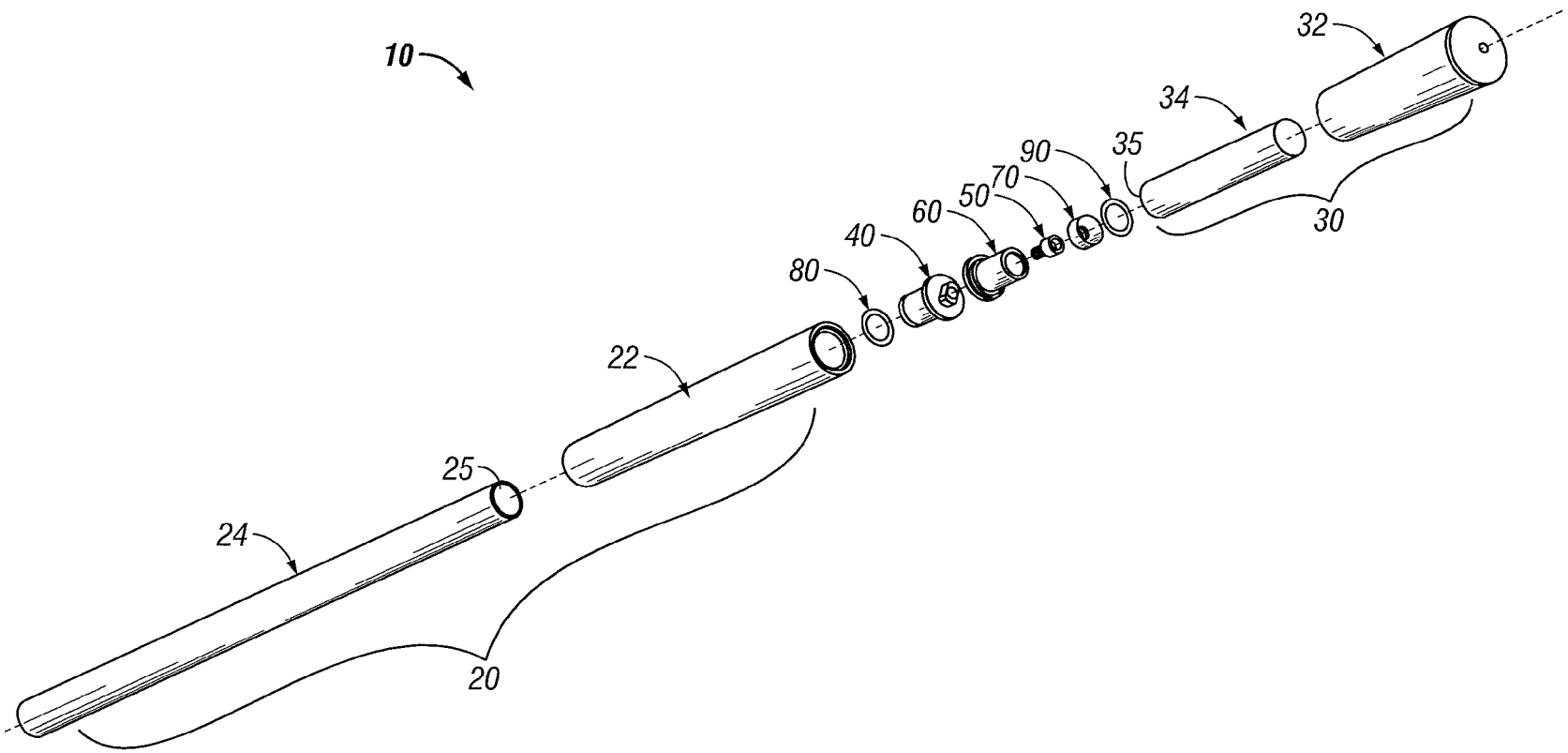
FIG. 1 is an exploded side view of the variable length shaft of the present invention.
Figure 2:
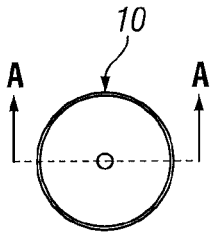
FIG. 2 is a top plan view of the variable length shaft of the present invention.
Figure 3:
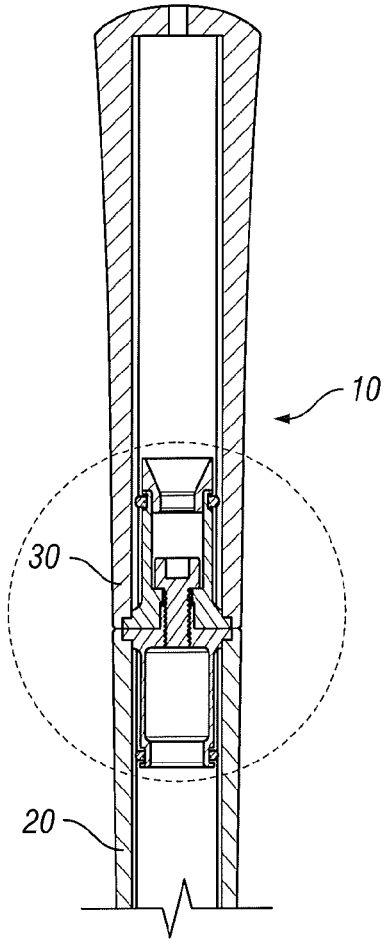
FIG. 3 is a side cross-sectional view of the variable length shaft shown in FIG. 2 along lines A-A.
Figure 4:
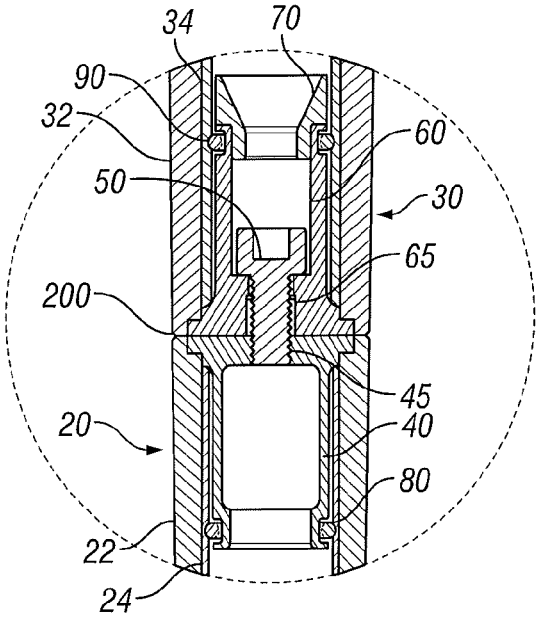
FIG. 4 is a close-up image of the circled section of the variable length shaft shown in FIG. 3.

A preferred embodiment of the present variable length shaft invention is shown in FIGS. 1-4. According to the preferred embodiment of the invention, and as shown in FIGS. 1 and 4, two sections of the shaft 10, the lower shaft and grip section 20 and the upper shaft and grip section 30, are joined together proximate the upper end 25 and lower end 35 of the shaft parts 24, 34, respectively, along a demarcation line 200, the line at which the two ends 25, 35 meet.

As shown in FIGS. 1, 3, and 4, the lower shaft and grip section 20 includes a lower portion of a grip 22 that encircles and is affixed to a lower part of the shaft 24 with double-sided adhesive tape (not shown). In other embodiments, the grip 22 may be affixed to the shaft 24 with another type of adhesive material. A lower adapter 40 is affixed to or otherwise situated proximate the upper, interior surface of the lower part of the shaft 24, and a lower-adapter o-ring 80 may be used to seal or otherwise secure the connection between the lower adapter 40 and the interior surface of the lower part of the shaft 24, as shown in FIG. 4. The lower adapter 40 also contacts an interior surface of the lower grip 22 in the preferred embodiment of the present invention, also as shown in FIG. 4. This adapter 40 includes a threaded hole 45 in its center to receive a screw 50 that allows the adapter 40 to be fastened to the upper shaft and grip section 30.

The upper shaft and grip section 30 correspondingly has an upper grip portion 32 encircling and affixed to an upper shaft portion 34 with double-sided adhesive tape (not shown), or, in other embodiments, another kind of adhesive material. The upper shaft and grip section 30 has an upper adapter 60 affixed to or otherwise situated proximate the lower, interior surface of the upper shaft portion 34, and an upper-adapter o-ring 90 may be used to seal the connection between the upper adapter 60 and the upper shaft portion 34. The upper adapter 60 also contacts an interior surface of the upper grip 32 in the preferred embodiment of the present invention, which is also shown in FIG. 4. The upper adapter 60 has a hole 65, which in the preferred embodiment is not threaded, in its center to receive the screw 50 that mates with the lower adapter 40 associated with the lower shaft and grip section 20, and is affixed to a screw captivator 70 that prevents the screw 50 from falling out of or otherwise becoming dislodged from the upper adapter 60. In another embodiment, the hole 65 can be threaded.

As shown in FIGS. 1 and 4, assembly of the preferred embodiment of the invention requires that the lower shaft and grip section 20 and the upper shaft and grip section 30 be aligned and pressed together in their proper orientation at a demarcation line 200, the line where the two parts connect. The screw 50 located in the upper adapter 60 is threaded into the threaded hole 45 of the lower adapter 40 and tightened with a specifically provided tool 100, as shown in FIGS. 5A, 5B, 6A, and 6B. The adapters 40, 60 may further include anti-rotational features to restrict twisting along the shaft axis when they are screwed together. When the screw 50 has been secured, the two shaft and grip sections 20, 30 are interlocked securely together, thus allowing the club to be used to hit golf balls. This operation allows for a semi-permanent assembly that will make the golf club comply with the appropriate USGA rules of golf.

Figure 5A:
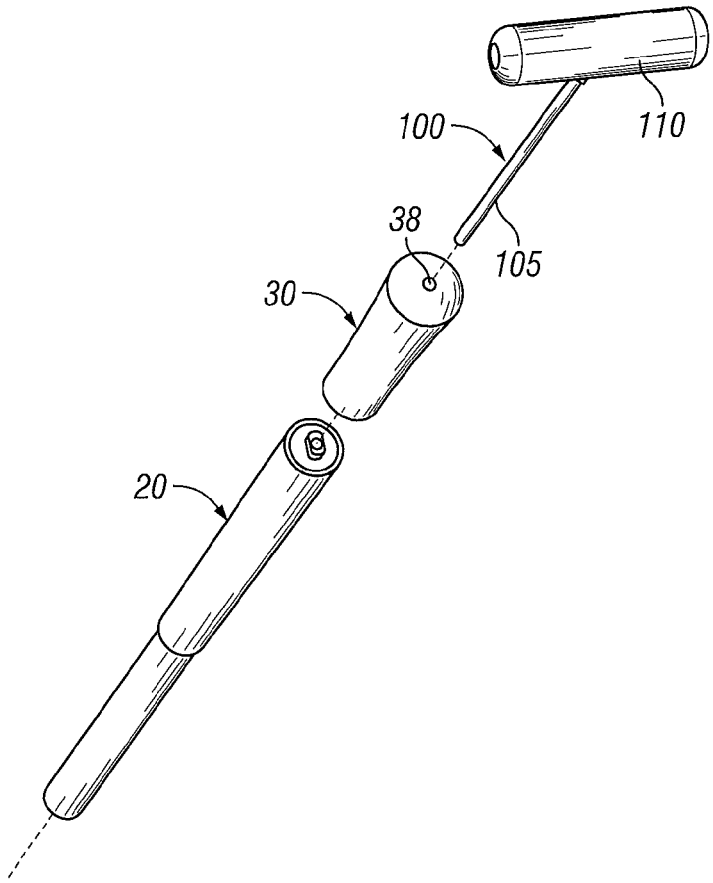
FIGS. 5A and 5B are side views of a tool interacting with an unassembled variable length shaft of the present invention.
Figure 5B:
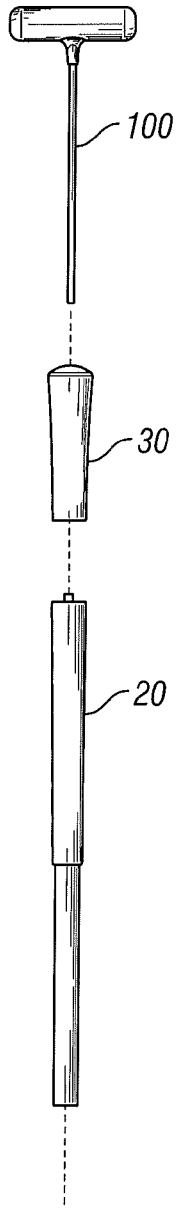
Figure 6A:
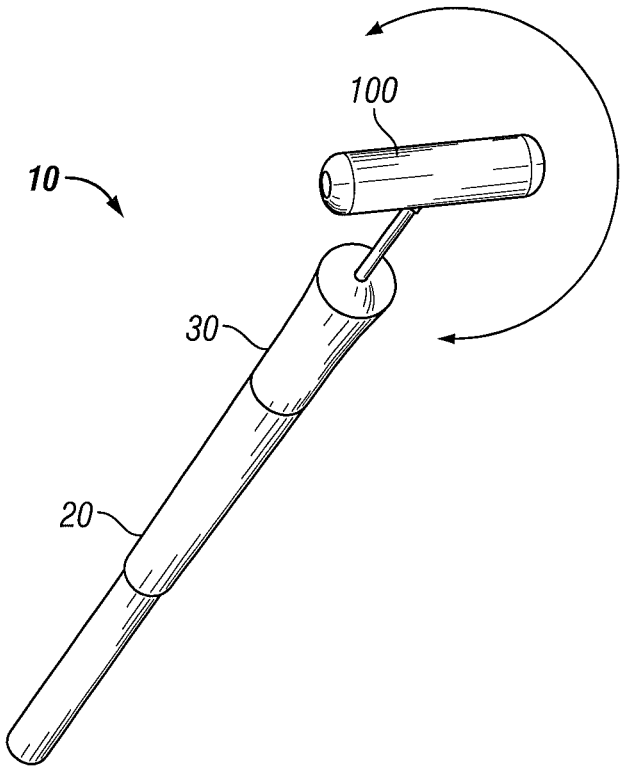
FIGS. 6A and 6B are side views of a tool interacting with an assembled variable length shaft of the present invention.
Figure 6B:
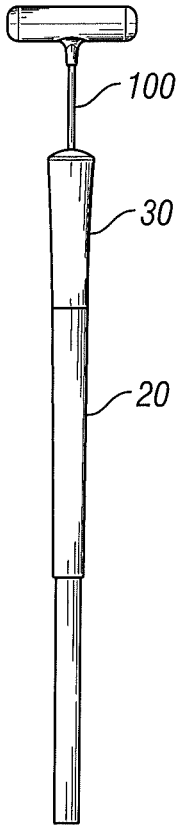

FIGS. 5A, 5B, 6A, and 6B show a tool 100, having an extension portion 105 and a head portion 110, which can be used to assemble the upper and lower shaft and grip sections 20, 30. As shown in FIG. 5A, and with reference to FIG. 4, the extension portion 105 of the tool fits through a hole 38 at the topmost portion of the upper grip portion 32, extends through the upper shaft portion 34, the screw captivator 70, and the upper adapter 60, and contacts the screw 50. The screw captivator 70 specifically guides the extension portion 105 to contact the screw 50. As shown in FIG. 6A, once the extension portion 105 of the tool 100 engages the head of the screw 50, the tool head portion 110 can be twisted clockwise or counterclockwise to tighten or loosen, respectively, the screw 50 and therefore the connection between the upper and lower shaft and grip sections 20, 30.

Figure 7:
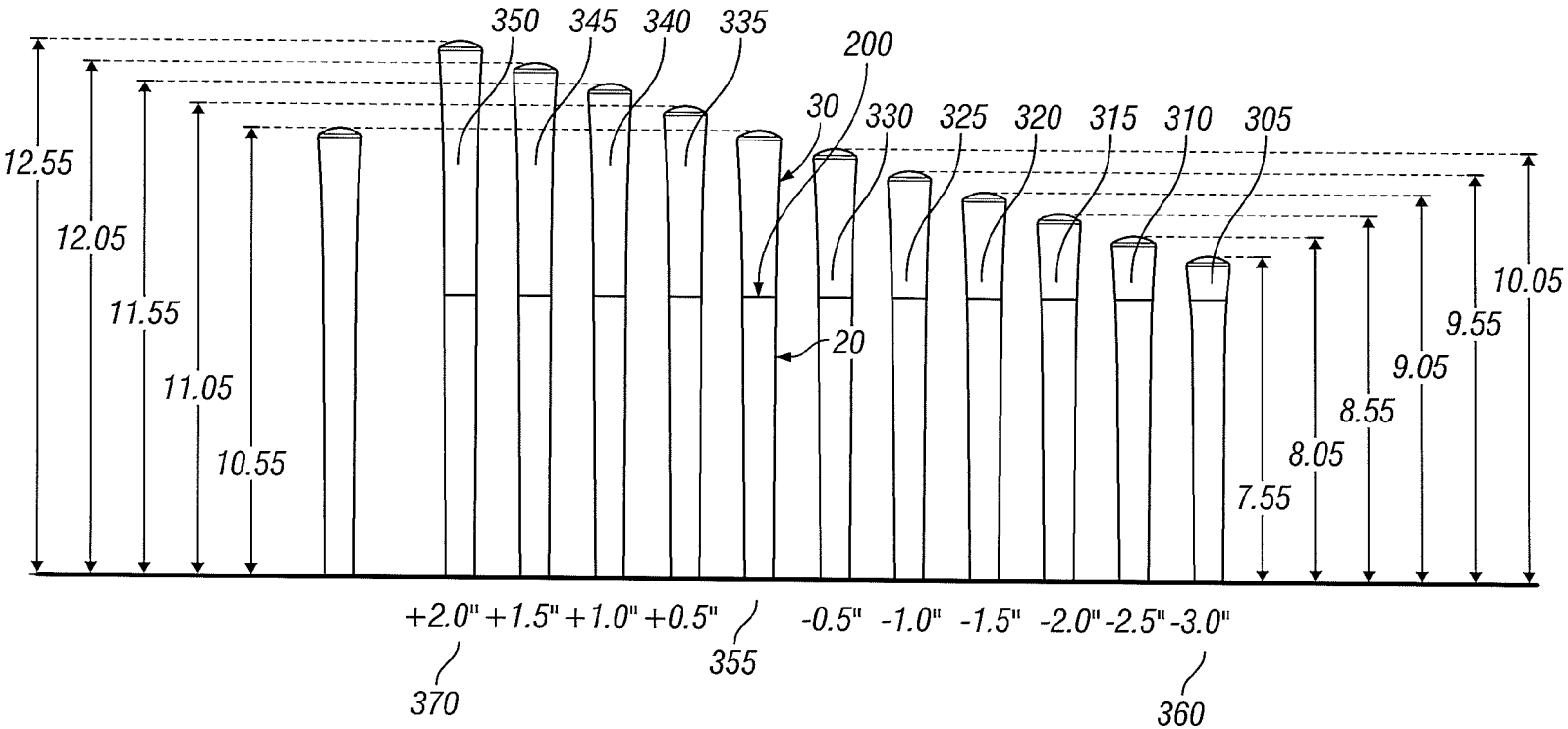
FIG. 7 is a side view of different lengths of upper shaft sections of the present invention.

In the preferred embodiment of the present invention, the length of the lower shaft and grip section 20 is not altered, as shown in FIG. 7. In other words, a golfer would not exchange the lower shaft and grip section 20 for a lower shaft and grip section 20 of a different length. The lower shaft and grip section 20 of the present invention thus can be permanently affixed to a desired golf club head (not shown). In contrast, according to the preferred embodiment of the present invention and as disclosed in FIG. 7, the upper shaft and grip section 30 of a normal length club 355 can be easily swapped for other upper shaft and grip sections 305, 310, 315, 320, 325, 330, 335, 340, 345, 350 having different lengths. The upper shaft and grip sections 305, 310, 315, 320, 325, 330, 335, 340, 345, 350 may also have different weights to allow the golfer to change the club weight as desired. Alternatively, the upper shaft and grip sections 305, 310, 315, 320, 325, 330, 335, 340, 345, 350 may all have the same weight.

FIG. 7 discloses an assortment of upper shaft and grip sections 30, each having different lengths such that the total club length can range from a short, 43-inch club 360 to a long, 48-inch club 370. The assortment of upper shaft and grip sections 30, 305, 310, 315, 320, 325, 330, 335, 340, 345, 350, shown in FIG. 7 may all be sold to a golfer with the lower shaft and grip section 20 in a kit form, or a smaller selection of such upper shaft and grip sections 30 may be included in a kit. As such, if a golfer wishes to increase the length of a shaft, he or she may remove the upper shaft and grip section 30 using the tool 100 and replace it with an upper shaft and grip section 30 having a greater length 335, 340, 345, 350. In contrast, if the golfer wishes to decrease the length of the shaft, he or she may remove the upper shaft and grip section 30 using the tool 100 and replace it with an upper shaft and grip section having a shorter length 305, 310, 315, 320, 325, 330. This invention thus allows the golfer to increase or decrease the length of a golf club shaft without detaching the lower shaft and grip section 20 from the club head or cutting or otherwise damaging any part of the shaft or grip.

The pieces of the variable length shaft 10 of the present invention may be composed of any number of materials, including metals, plastics, rubbers, and composites. The shaft portions 24, 34, the screw 50, the screw captivator 70, the adapters 40, 60, and the tool 100 may be composed of titanium, graphite or carbon composite, plastic, magnesium, aluminum, steel, or alloys of such materials, specifically stainless steel 17-7 or titanium 6-4. The shaft portions 24, 34 preferably are composed of graphite. The grip portions 22, 32 and the o-rings 80, 90 preferably are composed of a rubber material. The screw 50, the adapters 40, 60, and the screw captivator 70 preferably are composed of a metal material. The pieces of the variable length shaft disclosed herein may also be bonded together with an adhesive to prevent unwanted separation and ensure adequate strength during club use.

In a second embodiment of the invention, the variable length shaft 10 does not include grip sections 22, 32. In this second embodiment, the shaft 10 length is adjusted exactly as described herein, but without grip sections 22, 32, and a grip that is appropriately sized to the shaft 10 is added once the shaft 10 is completely assembled and has a desired length. The grip is preferably affixed to the shaft 10 with double sided tape, but may also be affixed with another type of adhesive material.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A variable length golf club shaft comprising:

at least one upper shaft portion;

a lower shaft portion;

a threaded fastener, wherein the threaded fastener removably connects the upper shaft portion to the lower shaft portion;

and upper adapter having a hole through its center and a lower adapter having a threaded hole through its center, wherein the upper adapter is affixed to a lower, interior surface of the upper shaft portion, wherein the lower adapter is affixed to an upper, interior surface of the lower shaft portion, wherein the threaded fastener is insertable through the holes in the center of the upper and lower adapters, and wherein a head portion of the threaded fastener is permanently enclosed by a screw captivator affixed to the upper adapter.

2. The variable length golf club shaft of claim 1, wherein the upper shaft portion comprises an upper shaft piece and an upper grip piece.

3. The variable length golf club shaft of claim 2, wherein the upper shaft piece is composed of a material selected from the group consisting of aluminum, aluminum alloy, titanium, titanium alloy, steel, magnesium, magnesium alloy, plastic, and graphite composite.

4. The variable length golf club shaft of claim 3, wherein the upper shaft piece is composed of graphite composite.

5. The variable length golf club shaft of claim 1, wherein the lower shaft portion comprises a lower shaft piece and a lower grip piece.

6. The variable length golf club shaft of claim 5, wherein the lower shaft piece is composed of a material selected from the group consisting of aluminum, aluminum alloy, titanium, titanium alloy, steel, magnesium, magnesium alloy, plastic, and graphite composite.

7. The variable length golf club shaft of claim 6, wherein the lower shaft piece is composed of graphite composite.

8. The variable length golf club shaft of claim 1, wherein the upper adapter is composed of a material selected from the group consisting of aluminum, aluminum alloy, titanium, titanium alloy, steel, magnesium, magnesium alloy, plastic, and graphite composite.

9. The variable length golf club shaft of claim 1, wherein the lower adapter is composed of a material selected from the group consisting of aluminum, aluminum alloy, titanium, titanium alloy, steel, magnesium, magnesium alloy, plastic, and graphite composite.

10. The variable length golf club shaft of claim 1, further comprising an upper o-ring disposed proximate the upper adapter and a lower o-ring disposed proximate the lower adapter.

11. The variable length golf club shaft of claim 1, further comprising at least two upper shaft portions, wherein the at least two upper shaft portions have different lengths.

12. The variable length golf club shaft of claim 11, wherein the at least two upper shaft portions differ in length from each other by no less than 0.5 inch.

13. The variable length golf club shaft of claim 11, wherein the at least two upper shaft portions differ in weight from each other.

14. The variable length golf club shaft of claim 11, wherein the at least two upper shaft portions have the same weight.

* * * * *